US006293332B2

(12) United States Patent
Li

(10) Patent No.: US 6,293,332 B2
(45) **Date of Patent: *Sep. 25, 2001**

(54) STRUCTURE OF A SUPER-THIN HEAT PLATE

(76) Inventor: Jia Hao Li, No. 2, Lane 127, Dang Ke St., Liu Tswo Sub-ward, Kang Shan Jen, Kao Hsiung Hsien (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/281,777

(22) Filed: Mar. 31, 1999

(51) Int. Cl.[7] ..... F28D 15/00; H05K 7/20

(52) U.S. Cl. ..... 165/104.26; 165/104.33; 361/700; 257/715

(58) Field of Search ..... 165/104.26, 104.33, 165/166; 29/890.032; 361/700; 257/715

(56) References Cited

U.S. PATENT DOCUMENTS

| | | | | |
|---|---|---|---|---|
| 3,604,503 | * | 9/1971 | Feldman, Jr. | 165/46 |
| 3,613,778 | * | 10/1971 | Feldman, Jr. | 165/104.26 |
| 4,461,343 | * | 7/1984 | Token | 165/104.26 |
| 4,880,052 | * | 11/1989 | Meyer, IV et al. | 165/104.26 |
| 4,917,175 | * | 4/1990 | Sakaya et al. | 165/46 |
| 5,427,174 | * | 6/1995 | Lomolino, Sr. et al. | 65/104.26 |
| 5,465,782 | * | 11/1995 | Sun et al. | 165/104.26 |
| 5,642,776 | * | 7/1997 | Meyer, IV et al. | 165/104.26 |
| 5,697,428 | * | 12/1997 | Akachi | 165/104.21 |
| 5,725,049 | * | 3/1998 | Swanson et al. | 165/104.26 |
| 6,167,948 | * | 1/2001 | Thomas | 165/104.26 |

FOREIGN PATENT DOCUMENTS

| | | | | |
|---|---|---|---|---|
| 19818839A1 | * | 10/1999 | (DE) . | |
| 2235792 | * | 10/1999 | (DE) | 165/104.26 |
| 0082290 | * | 6/1980 | (JP) | 29/890.032 |
| 406026772 | * | 6/1980 | (JP) | 29/890.032 |
| 0083587 | * | 4/1988 | (JP) | 165/104.26 |
| 0561072 | * | 6/1980 | (SU) | 29/890.032 |

* cited by examiner

*Primary Examiner*—Ira S. Lazarus
*Assistant Examiner*—Tho V Duong
(74) *Attorney, Agent, or Firm*—Rosenberg, Klein & Lee

(57) ABSTRACT

A structure of a super-thin heat plate comprising surrounding bodies having a thin plate shape and supporting body is disclosed. Each supporting body have function of capillarity and is enclosed within the surrounding bodies. The surrounding bodies and the supporting body are connected by a plurality of welding spots, and the edges are properly sealed. The supporting body is distributed uniformly by a whole web structure. Thus, the heat plate wick structure is very stable with a preferred performance of heat transfer and can be finished easily. In mass production, the structure still has a high stability.

2 Claims, 12 Drawing Sheets

STRUCTURE OF A SUPER-THIN HEAT PLATE

BACKGROUND OF THE INVENTION

1. Field of the Invention

The present invention relates to structure of a super-thin heat plate, and particularly to a structure of a super-thin plate heat tube which has a stable structure, a preferred performance of heat transfer, and a low cost.

2. Description of the Prior Art

The prior art heat tubes are installed with a wick structure which is a metal net with the function of capillarity. By the capillarity of the wick structure, the working fluid of the heat tube is transferred successfully. However, the prior art heat tube is made as a circular tube. But the current electronic device is required to be compact, thus the prior art circular tube can not meet the current requirement. While general plate shape heat tube is easily to be collapsed by vacuum, difficult to be finished, and has a bad performance of heat transfer and a large contact thermal resistance, a unstable wick structure, a high cost, slow manufacturing speed. The flat adhering operation of the wick structure is difficult and the spot welding is difficult.

SUMMARY OF THE INVENTION

Accordingly, the object of the present invention is to provide a structure of a super-thin heat plate comprising surrounding bodies having a thin plate shape and a supporting body. Each supporting body have capillarity and is enclosed within the surrounding bodies. The surrounding bodies and the supporting body are connected by a plurality of welding spots, and the edges are properly sealed. The supporting body is distributed uniformly by a whole web structure. Thus, the plate heat plate wick structure is very stable with a preferred performance of heat transfer and can be finished easily. In mass production, the structure still has a high stability. The supporting body is distributed uniformly by a whole web structure. Thus, the plate heat plate wick structure is very stable. In mass production, the structure still has a high stability. The finishing of the shape of the supporting body is simple and has a lower cost. The supporting body may be fabricated rapidly. By the structure of the supporting body, the operation of contact with container in the wick structure is simple and stable.

The present invention will be better understood and its numerous objects and advantages will become apparent to those skilled in the art by referencing to the following drawings in which:

DETAILED DESCRIPTION OF THE PREFERRED EMBODIMENT

Figure 2:
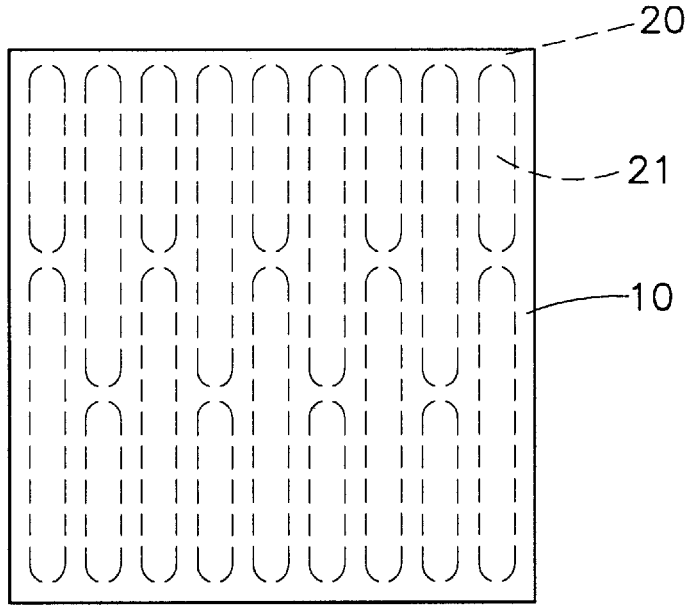
FIG. 2 is an upper view of the present invention.
Figure 1:
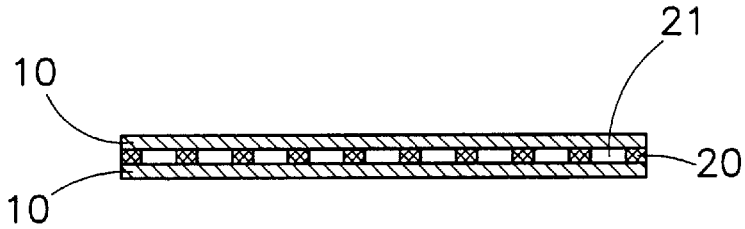
FIG. 1 is a cross sectional view of the present invention.
Figure 3:
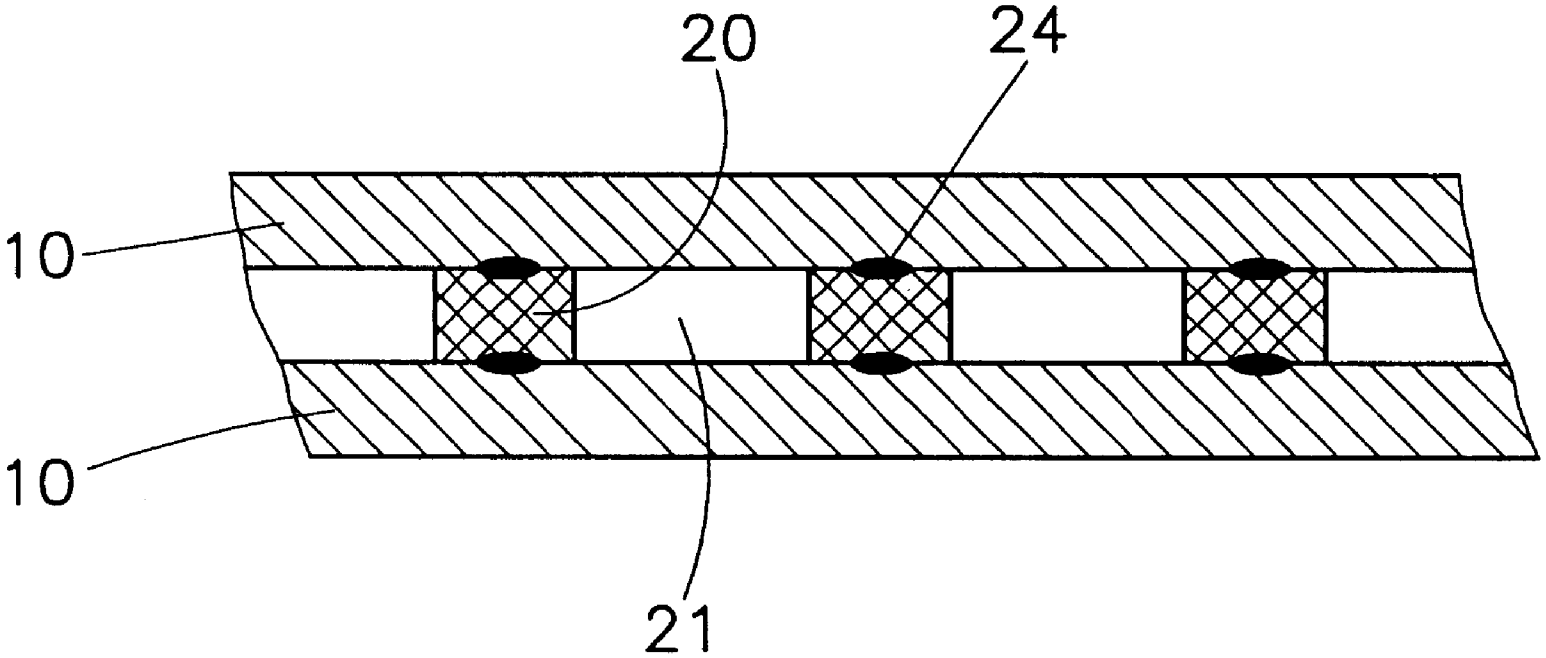
FIG. 3 is a local cross sectional view of the present invention.

Referring now to FIGS. 1, 2 and 3, a structure of a super-thin heat plate is disclosed. The structure of a super-thin heat plate according to the present invention includes two surrounding bodies 10 and a supporting body 20. Each surrounding body 10 is a thin metal plate, the area of which can be adjusted as desired. Two surrounding bodies 10 may be separated metals or be connected as a whole metal plate which are folded in half so as to be formed as an upper and a lower surrounding bodies 10, and thus the supporting body 20 can be held between the two surrounding bodies.

Figure 9:
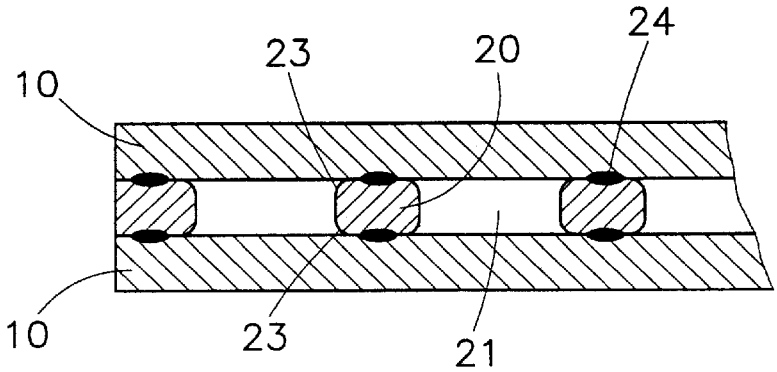
FIG. 9 is a local upper view illustrating the blanking hole of the supporting body according to the present invention the edge of which is installed with chamfers.
Figure 5:
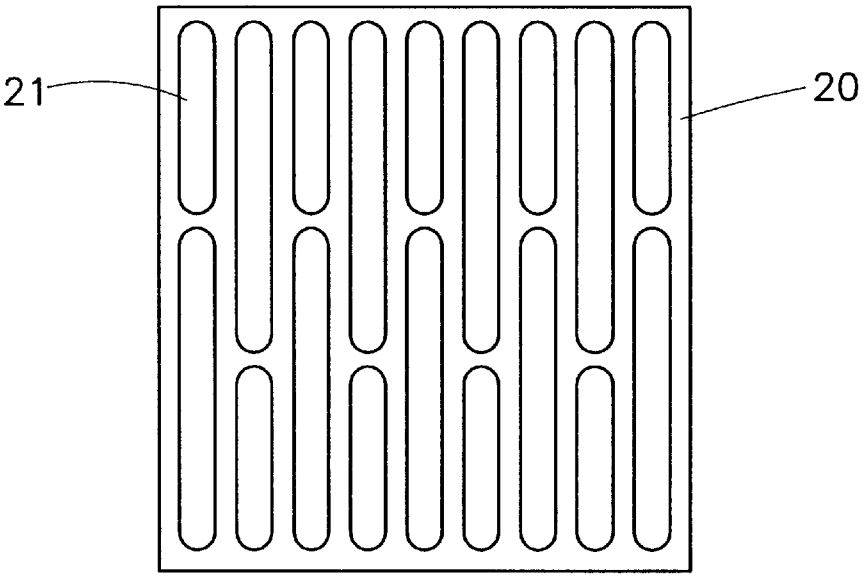
FIG. 5 is an upper view of the supporting body of the present invention.
Figure 4:
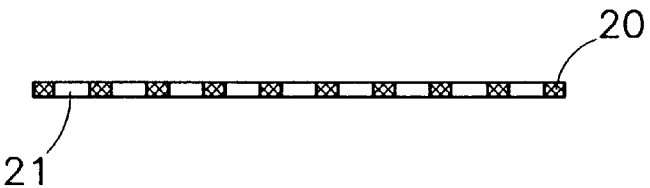
FIG. 4 is a cross sectional view showing the supporting body of the present invention.
Figure 8:
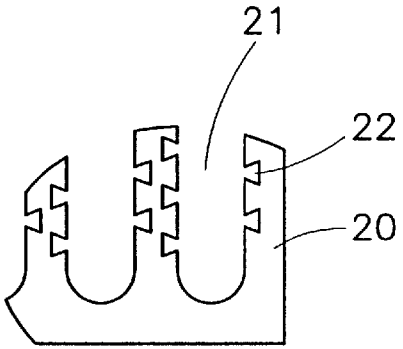
FIG. 8 is a local upper view illustrating the blanking hole of the supporting body according to the present invention the edge of which is installed with holes.
Figure 7:
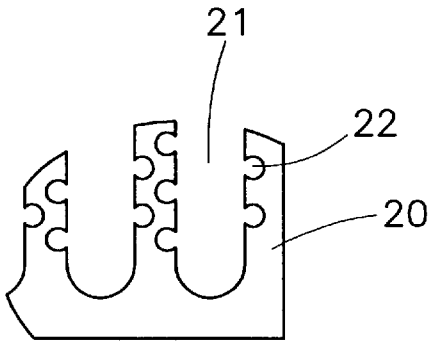
FIG. 7 is a local upper view illustrating the blanking hole of the supporting body according to the present invention the edge of which is installed with holes.
Figure 6:
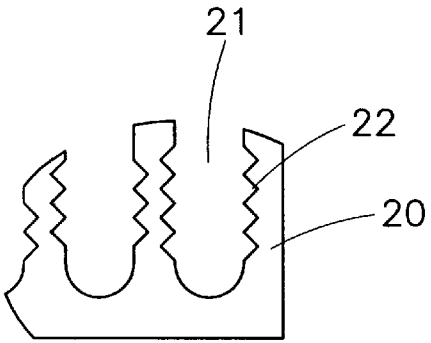
FIG. 6 is a local upper view illustrating the blanking hole of the supporting body according to the present invention the edge of which is installed with holes.
Figure 11:
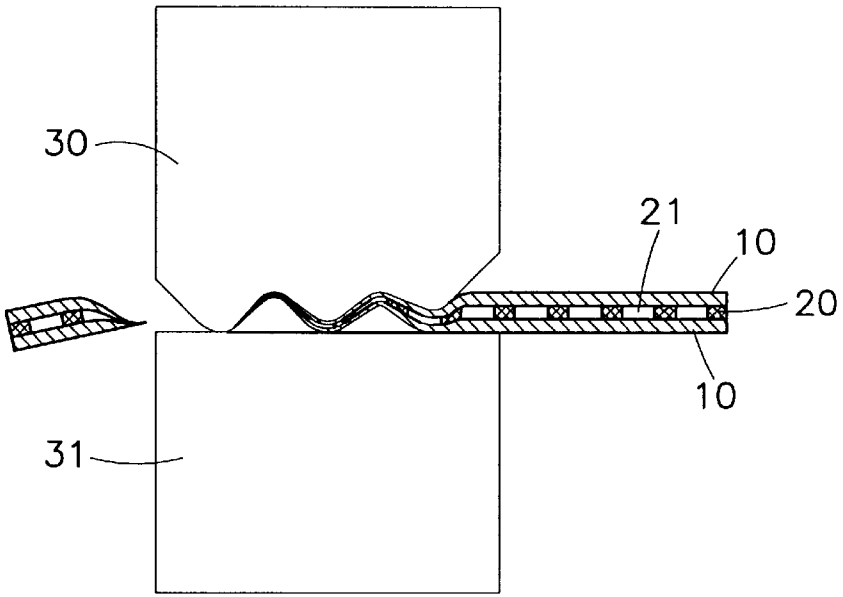
FIGS. 10~12 is a cross schematic view showing the operation of sealing edge in the present invention.

The supporting body 20 is a metal plate or a metal web having capillarity. In this embodiment, the supporting body 20 is a metal plate. The area of the plate shape supporting body 20 is approximately equal to that of the surrounding body. The supporting body 20 is formed with a plurality of blanking holes 21 by blanking (as shown in FIGS. 4 and 5). Preferably, the blanking holes are interleaved with each other so that the supporting body 20 may be formed as a wick structure. Another, each edge of the blanking hole 21 is installed with wick structures having a plurality of holes 22 (as shown in FIGS. 6 and 8). The holes 22 may have a triangular, a trapezoid, or a circular shape for increasing the capillary force of the supporting body 20 and the operation angle of inclination. Moreover, chamfer structure 23 is formed on the edge of blanking hole of the supporting body 20 for generting capillary force by grinding and oscillating (as shown in FIG. 9). If the supporting body 20 is a metal web, the blanking hole 21 and other structures are unnecessary.

Figure 10:
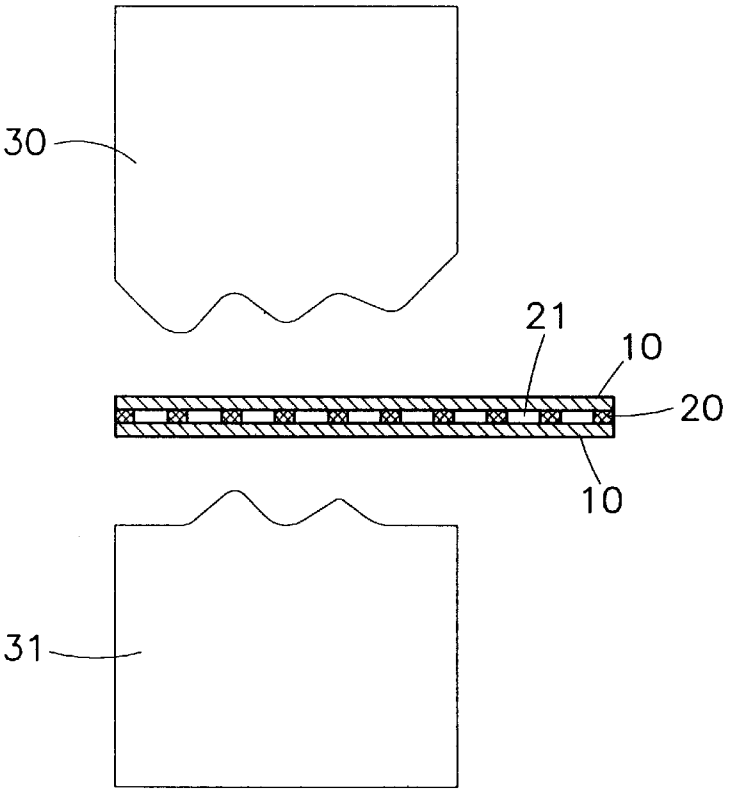
Figure 12:
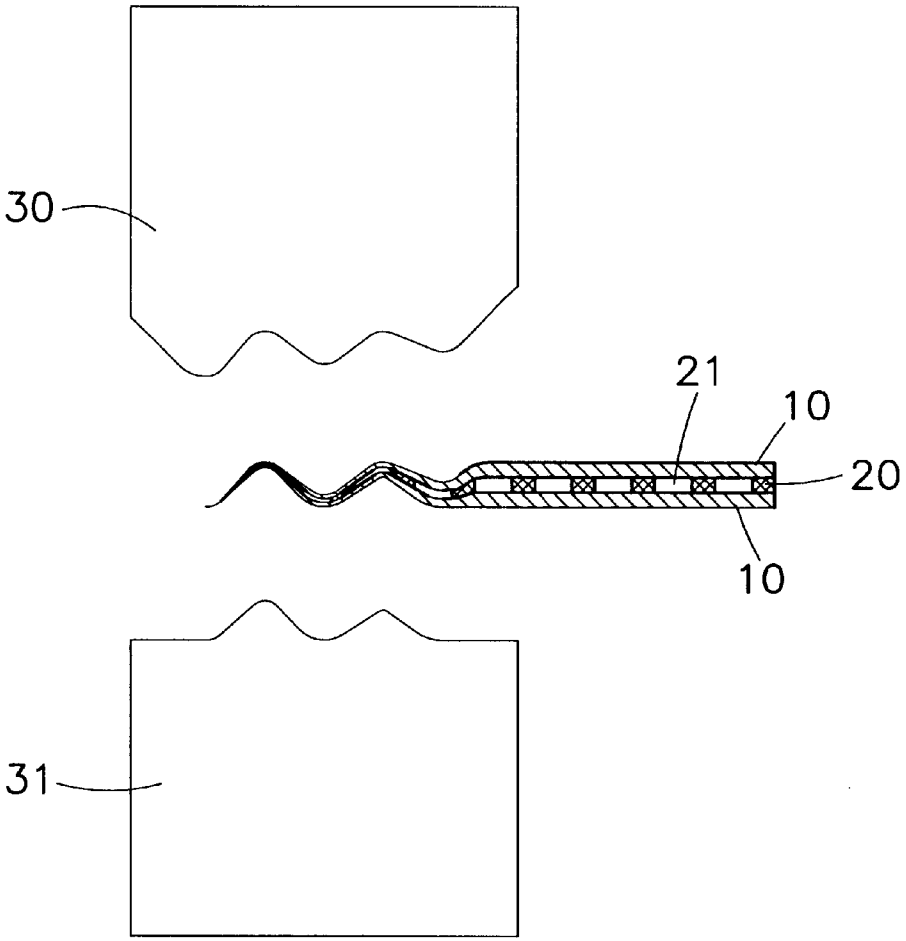
Figure 13:
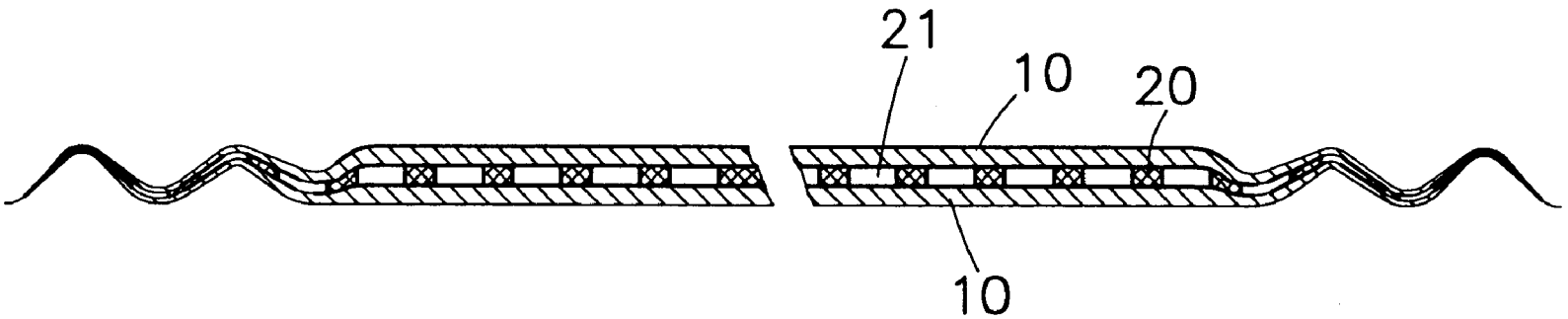
FIG. 13 is a cross sectional view showing the edge of the present invention has been sealed.

The supporting body 20 is installed between the upper and the lower surrounding body 10 which are connected by a plurality of welding spots 24. Then seal molds 30 and 31 serve to seal the edges of the surrounding bodies 10 and the supporting body 20 (as shown in FIGS. 10 and 12). The connecting surfaces of the seal molds 30 and 31 have a wave shape. Therefore, after the surrounding bodies 10 and the supporting body 20 are closed, a wave shape seal structure is formed. Further, tin is adhered on the sealing edge so as to seal the connection portion. By the aforementioned, a structure of a super-thin heat plate according to the present invention is formed (as shown in FIG. 13).

Figure 14:
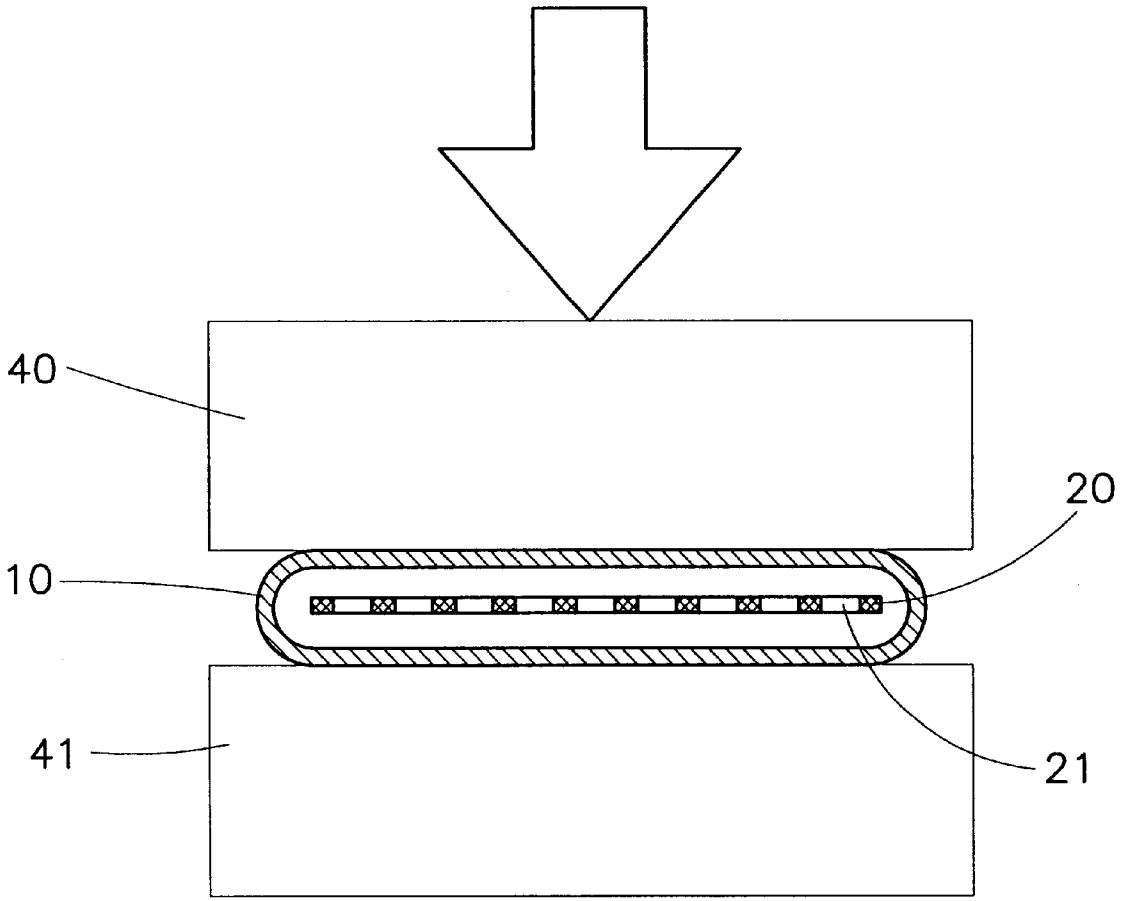
FIG. 14 is a cross sectional view of another embodiment according to the present invention.

Moreover, as shown in FIG. 14, the surrounding body 10 according to the present invention may be a round tube with a proper length. A supporting body 20 is inserted into the surrounding body 10, and then a collapsing molds 40 and 41 serve to collapse the tubular surrounding body 10 to form as a thin plate.

Figure 15:
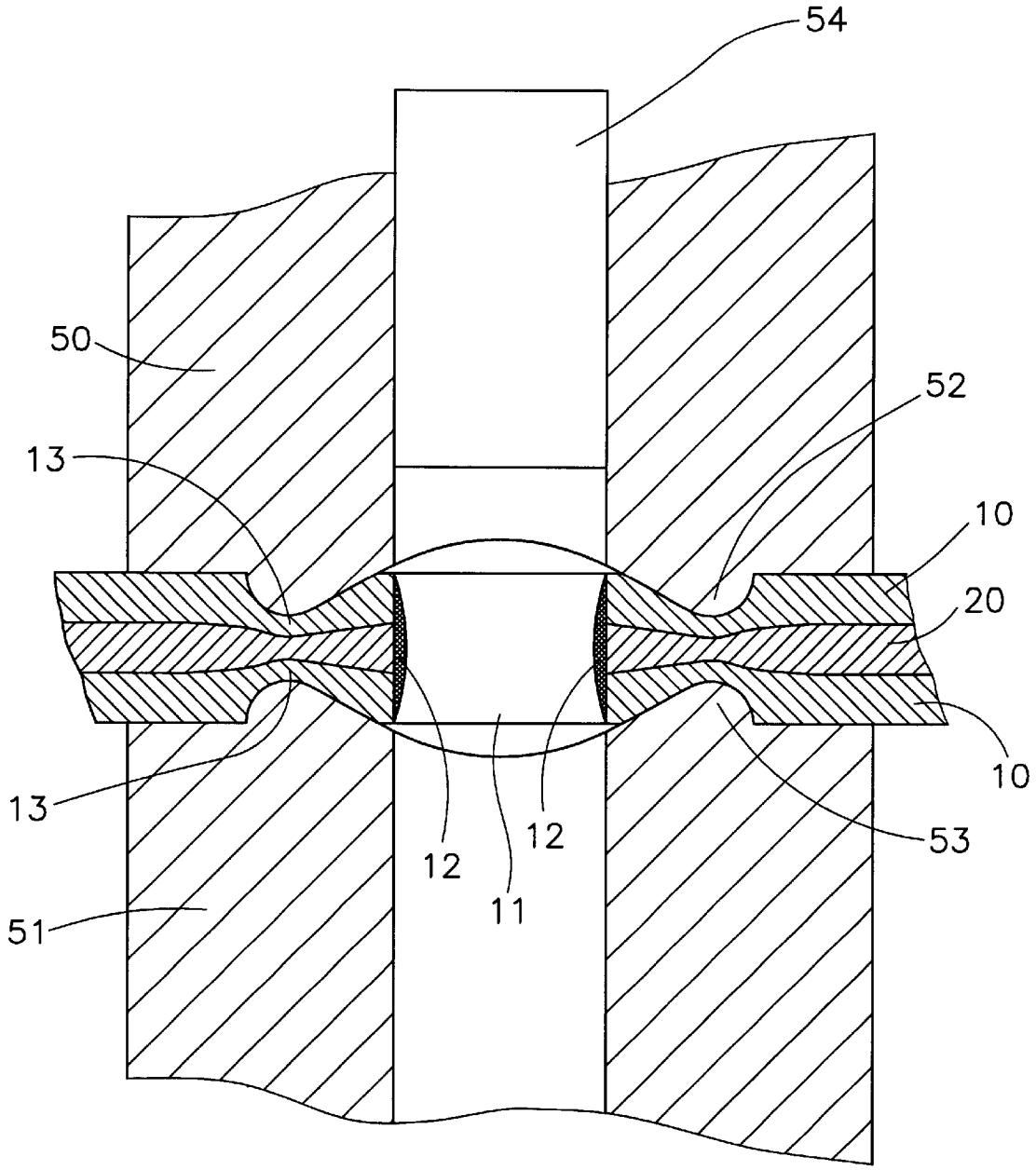
FIG. 15 is a schematic view showing a fixing hole of the present invention being formed by blanking.
Figure 16:
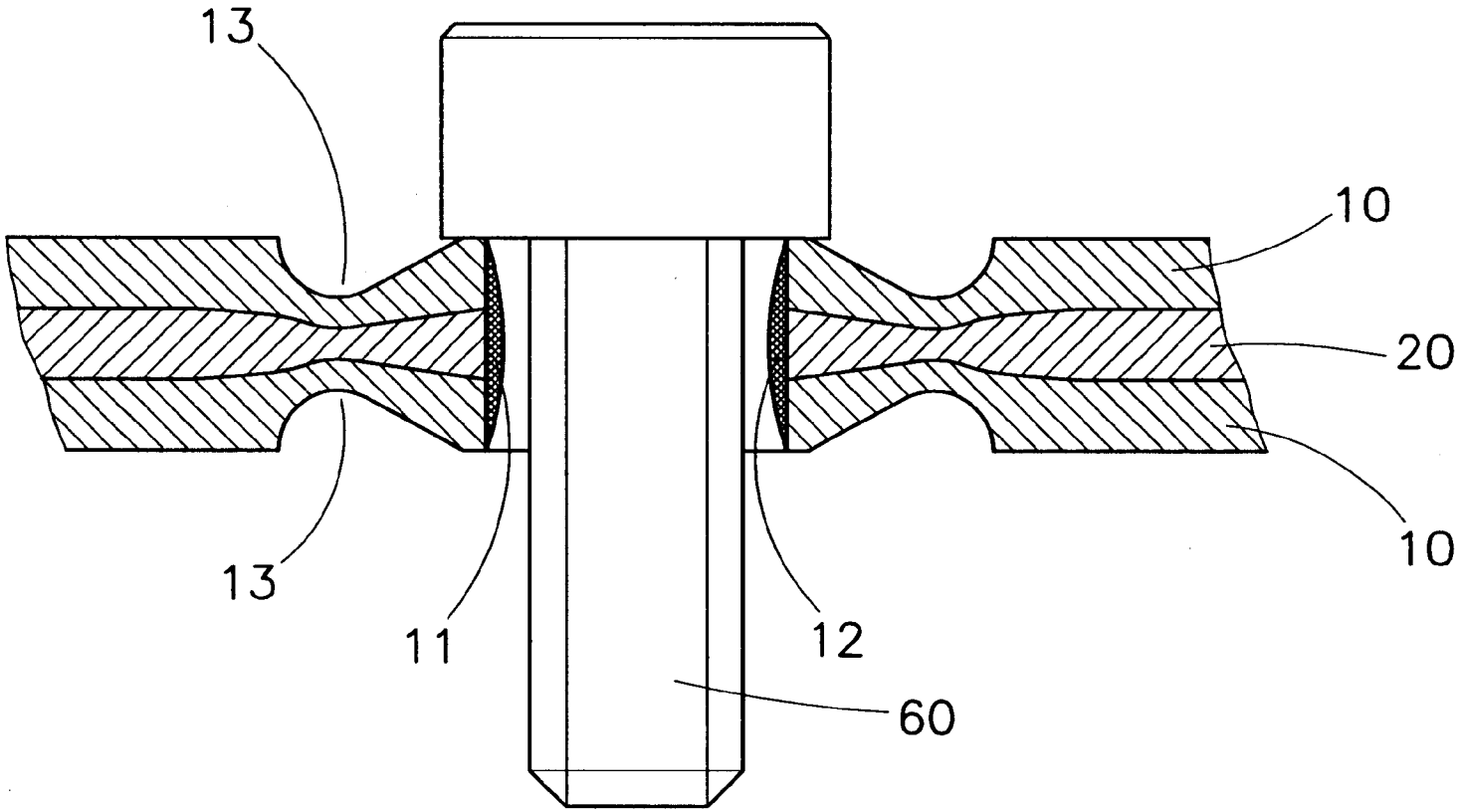
FIG. 16 is a schematic view showing the fixing lock hole according to the present invention.

Another, as shown in FIG. 15, in the present invention, special blanking molds serve to blank a fixing hole. The connecting surface of the blanking molds 50 and 51 are circularly installed with convex portions 52 and 53. The middle portion of the convex portions 52 and 53 are installed with a punching body 54. The structure of a super-thin heat plate according to the present invention may be formed with a fixing hole 11 by the punching body 54. Due to the design of the convex portion 52 and 53 at the blanking molds 50 and 51, when the blanking molds 50 and 51 are combined for blanking, the convex portions 52 and 53 may be blanked on the surrounding bodies 10 and the supporting body 20 on the outer periphery of the fixing hole 11 so that the outer periphery of the fixing hole 11 can be formed with a concave portion 13 by blanking. Thus, the periphery of the fixing hole 11 are connected tightly in order to prevent draining during formation of the fixing hole 11. Moreover, tin 12 can be adhered to the fixing hole 11 for sealing. As shown in FIG. 16, by screwing a screw 60 to pass through the fixing hole 11, the structure of a super-thin heat plate according to the present invention is locked to a proper position.

Figure 17:
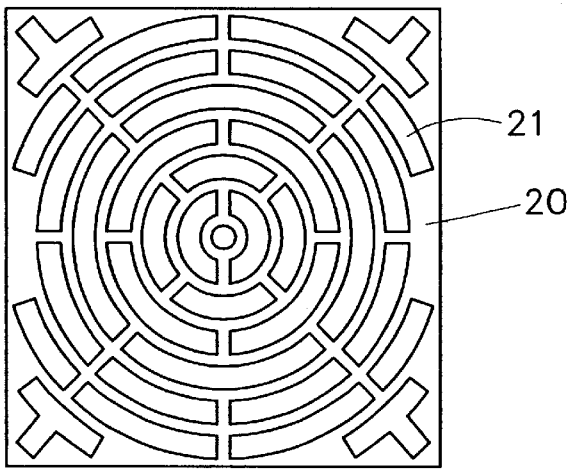
FIGS. 17~19 is an upper view showing various types of the supporting body according to the present invention.
Figure 19:
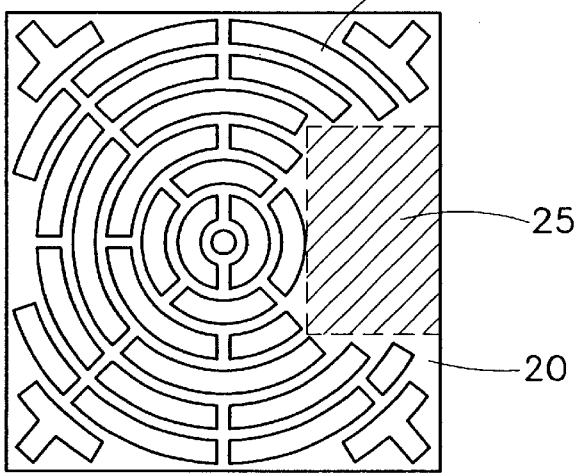
Figure 18:
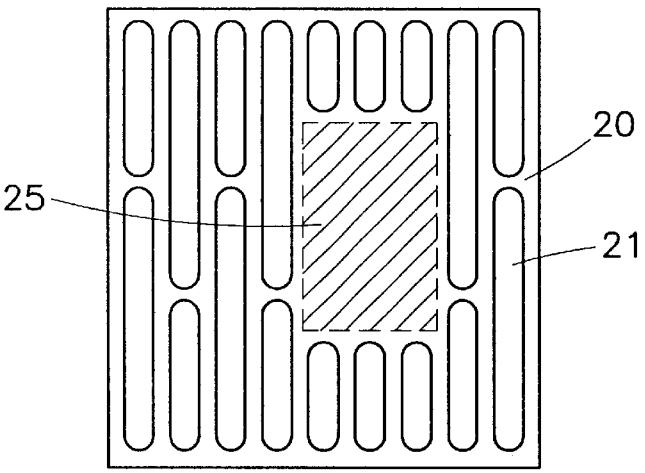

Moreover, as shown in FIG. 17, the blanking holes 21 blanked on the plate supporting body 20 can be formed as concentric circles or be arranged with a radiating shape, or be arranged by other configurations. Moreover, as shown in FIGS. 18 and 19, the supporting body 20 may be installed with a non-conductive region 25 installed with a blanking hole 21 for being as a region for confining the heat transfer.

Figure 20:
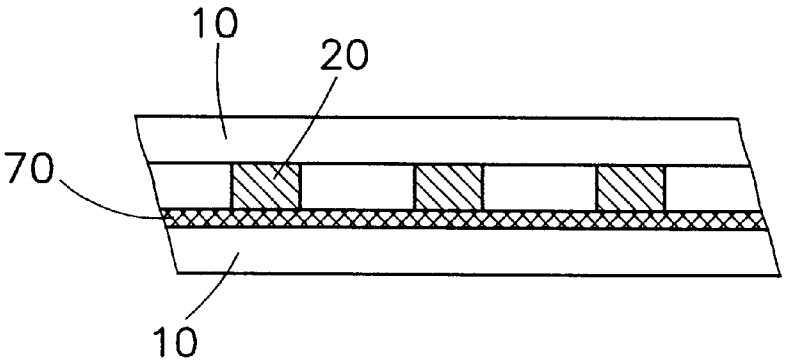
FIG. 20 is a cross sectional view showing a further embodiment of the present invention.
Figure 21:
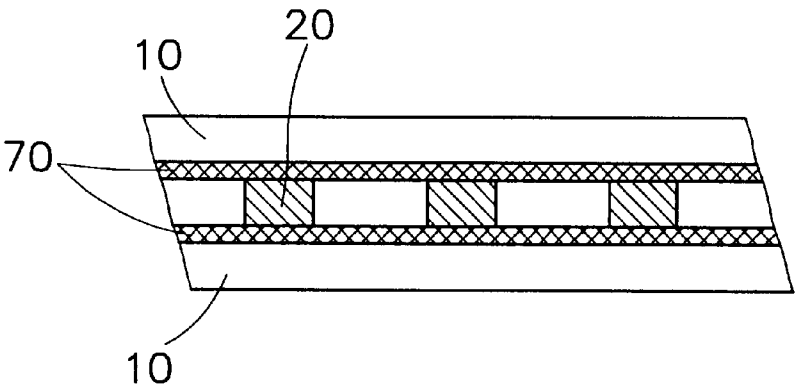
FIG. 21 is a cross sectional view showing the other embodiment of the present invention.

Moreover, as shown in FIGS. 20 and 21, a proper wick structure 70 can be installed between the surrounding body 10 and the supporting bodies 20.

As described above, the structure of a super-thin heat plate according to the present invention has the following advantages:

1. The supporting body may be formed by wick material, so as to be formed as a super-thin plate heat tube (the outer diameter thereof is smaller than 1 mm or less)
2. The supporting body is uniformly distributed, the vacuum within the heat tube will not deform the structure.
3. Since the surrounding body is distributed uniformly, thus the inner and outer structures are stable. The plate heat tube has a preferred performance of heat transfer. Since the inner and outer structures are uniformly, the contact thermal resistance are also small.
4. The supporting body is distributed uniformly by a whole web structure. Thus, the plate heat plate wick structure is very stable. In mass production, the structure still has a high stability.
5. The supporting body is distributed uniformly by a whole web structure. Thus the heat plate may be finished by bending, inwards punching or outwards punching according to the requirement of structure. The structure still very stable.
6. The finishing of the shape of the supporting body is simple and has a lower cost. The supporting body may be fabricated rapidly.
7. By the structure of the supporting body, the operation of contact with container in the wick structure is simple and stable.
8. Since the distribution of the supporting body is uniform and flat, the spot welding is simple and rapidly (for preventing a larger pressure to be generated within the heat tube so to inflation and then deform).
9. The blanking holes of the supporting body can be arranged with a special path according to the requirement of practical application so that the plate heat tube will transfer heat in the specific direction, or confine the heat transfer in a specific area.
10. The seal structure is very simple, the finishing cost is low, and the structure has a preferred rigidity so as not to be destroyed.

Although the present invention has been described using specified embodiment, the examples are meant to be illustrative and not restrictive. It is clear that many other variations would be possible without departing from the basic approach, demonstrated in the present invention. Therefore, all such variations are intended to be embraced within the scope of the invention as defined in the appended claims.

What is claimed is:

1. A structure of a super-thin heat plate comprising a pair of surrounding bodies having planar surfaces disposed one above the other and a supporting body sandwiched between said pair of surrounding bodies, each of said surrounding bodies being formed by a thin plate-shaped member, said supporting body being formed by a plate-shaped member having a pair of opposing planar surfaces respectively disposed in contiguous relationship with said planar surfaces of said surrounding bodies, said supporting body having a plurality of openings formed therethrough and enclosed by said surrounding bodies to respectively define a plurality of capillaries, said surrounding bodies and said supporting body being connected together by a plurality of welding spots, and edges of said heat plate being sealed, each of said plurality of openings of said supporting body being circumscribed by an edge portion having a wick structure defined by a plurality of holes formed therein.

2. A structure of a super-thin heat plate comprising a pair of surrounding bodies each having a thin plate shape, at least one plate supporting body formed by a metal plate enclosed between the pair of surrounding bodies, and a plurality of elongated blanking holes formed through the supporting body by blanking, an edge of each blanking hole being provided with a wick structure having a plurality of concave holes, the surrounding bodies and the supporting body being connected by a plurality of spot welds, and peripheral edges of the surrounding bodies being sealed.

* * * * *